US007271696B2

(12) United States Patent
Piaskowski

(10) Patent No.: US 7,271,696 B2
(45) Date of Patent: Sep. 18, 2007

(54) TWO PART TRANSFORMER CORE, TRANSFORMER AND METHOD OF MANUFACTURE

(75) Inventor: Andrew D. Piaskowski, St. Lazare (CA)

(73) Assignee: Groupe Delta xfo Inc., Boucherville, Quebec (CA)

( * ) Notice: Subject to any disclaimer, the term of this patent is extended or adjusted under 35 U.S.C. 154(b) by 160 days.

(21) Appl. No.: 11/010,340

(22) Filed: Dec. 14, 2004

(65) Prior Publication Data

US 2006/0125593 A1 Jun. 15, 2006

(51) Int. Cl.
*H01F 27/28* (2006.01)
*H01F 27/02* (2006.01)

(52) U.S. Cl. ..... 336/229; 336/60; 29/602.1

(58) Field of Classification Search ..... 336/60, 336/59, 229, 5, 62, 220; 29/602.1
See application file for complete search history.

(56) References Cited

U.S. PATENT DOCUMENTS 3,587,020 A 6/1971 Waasner ..... 336/212
3,621,425 A 11/1971 Trench ..... 336/61
4,199,743 A * 4/1980 Martincic ..... 336/96
5,455,553 A * 10/1995 Allan et al. ..... 336/170
5,838,220 A 11/1998 Hagberg
6,185,811 B1 * 2/2001 Perry ..... 29/606
6,268,785 B1 * 7/2001 Kollman et al. ..... 336/83
2002/0011914 A1 1/2002 Ikeura et al.
2003/0117251 A1 * 6/2003 Haugs et al. ..... 336/182
2004/0061584 A1 4/2004 Darmann

OTHER PUBLICATIONS

Butler Winding "Transformer and Inductor Core Types, an Overview". Internet Document CN1278628A entitled "Material Saving Transformer", Clapper, Feb 119, 04.

* cited by examiner

*Primary Examiner*—Anh Mai
(74) *Attorney, Agent, or Firm*—Kent Daniels; Ogilvy Renault LLP

(57) ABSTRACT

A toroidal transformer core topology having improved thermal and electrical properties has a two part core, one part concentrically disposed within the other, with the windings wound between the two. Less expensive materials and less material can be used to construct the core. The core can be constructed using inexpensive and efficient methods.

22 Claims, 6 Drawing Sheets

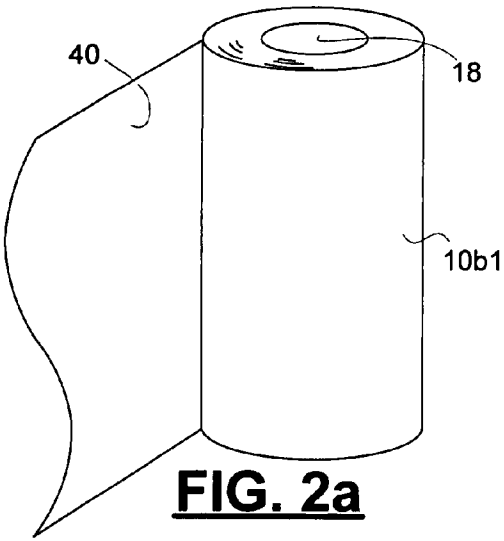
FIG. 2a
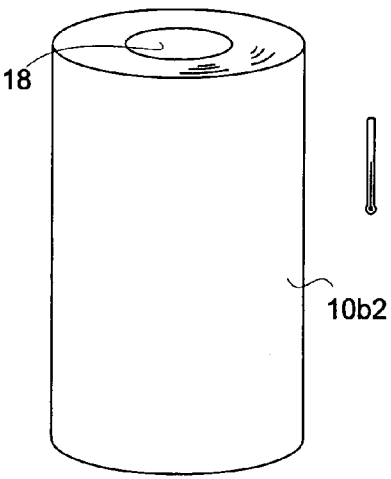
FIG. 2b
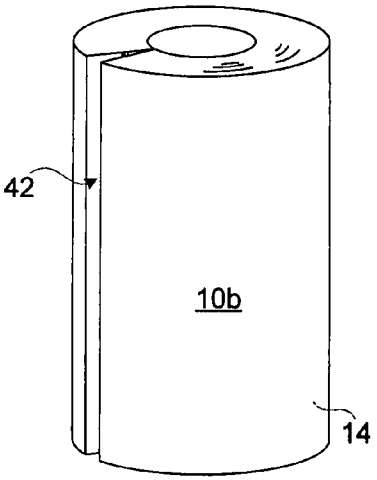
FIG. 2c
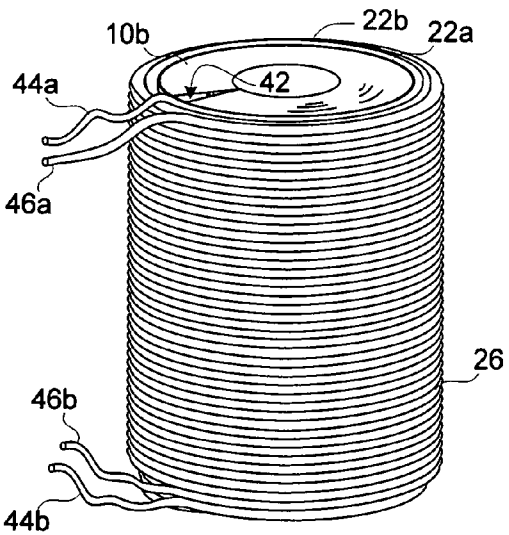
FIG. 2d
FIG. 2e
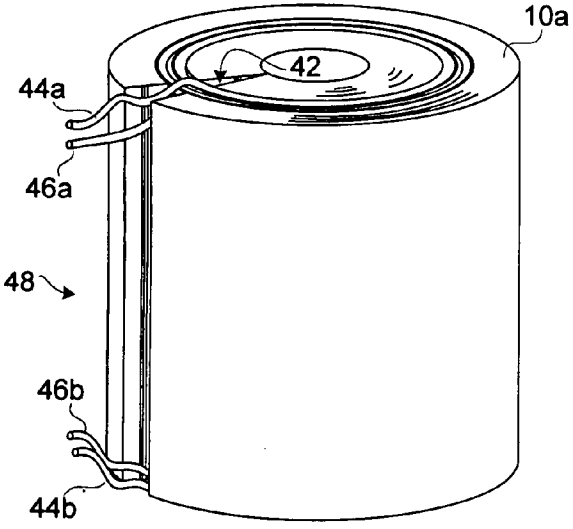
FIG. 2f

TWO PART TRANSFORMER CORE, TRANSFORMER AND METHOD OF MANUFACTURE

CROSS-REFERENCE TO RELATED APPLICATIONS

This is the first application filed for the present invention.

MICROFICHE APPENDIX

Not Applicable.

TECHNICAL FIELD

The present invention relates in general to power transformation, and in particular to a two part transformer core and transformers made with such a core.

BACKGROUND OF THE INVENTION

Transformers for distribution and power have improved greatly in the last decade due to improved materials, and sophisticated design tools for optimizing performance, cost and size. Recent energy saving legislation in North America commonly known as "Energy Star" in the USA and "C 802" in Canada drive the issues of cost and energy savings, which has spawned significant developments in the art of transformer design. Manufactures are faced with an ever-increasing competitive market and stringent power efficiency requirements for their products.

A large part of transformer costs is based on material, such as the copper/aluminum (for windings) and steel (for magnetic cores). Magnetic materials available to the transformer industry have been designed for known transformer topologies. The producers of 'soft magnetic materials' for the transformer industry, have consequently, made it difficult to realize new transformer topologies.

Transformers can take many forms. Some are applied to single phase or three phase applications and others provide a multitude of voltages and phases depending on the need and application. Known transformer topologies can take various forms, for example the most common single or 3-phase transformers are classified as 'core type' or 'shell type' transformers. The core type transformer is recognizable by external windings surrounding a magnetic core, whereas a shell type transformer is recognized by a core extending around a part of the windings.

Transformer size dictates the power handling capacity of the transformer and its ability to dissipate transformer generated heat produced as a result of transformer energy or power losses. Usually, the two greatest loss components are contributed by the resistive losses in the transformer, hysteresis and eddy current loss in the core. A cooling mechanism is needed to dissipate the heat maintaining a thermal equilibrium of the transformer, as otherwise "thermal runaway" occurs and the transformer fails.

Thermal runaway occurs when the energy or power losses of the transformer produces more heat than can be dissipated by the transformer. The ability to dissipate heat of a transformer is a function of many things, including: thermal resistance of the windings/core to a cooling medium (e.g. oil or air), a dissipation constant, a thermal coefficient of resistance of windings, core properties, a thermal resistance of an electrical insulation system used to electrically insulate the windings, a physical geometry, and enclosure type, if used. Transformers most commonly used in the power and distribution industry are of 'dry type', i.e. where air is used as the cooling medium. As such, cooling of these transformers is predominantly performed by air passing around the windings.

For this reason, prior art transformer designs include portions of the windings and/or parts of the magnetic core that protrude or are exposed to the surrounding air (or other medium). This exposure to the medium permits the required cooling to prevent thermal runaway, and also compensates for an imperfect optimization between steel and copper content within available magnetic laminations or strip steel assembly configurations. In dry type transformers, the windings are normally configured to allow air to flow between the winding layers thus effectively increasing the cooling surface area. This is very wasteful in terms of winding wire material content since winding wire is expensive and can contribute to over half the total material content. Also the exposure of the windings and core brings about external leakage of flux. Furthermore, the thermal transfer between the copper winding and air is best when the winding is directly exposed to the air, but cannot exceed a certain thermal transfer rate. Typically 20 uW per $mm^2$ per degree Centigrade rise.

In reality the minimum material content of transformers are not materialized because of the thermal dissipation requirements, and because the costs of materials, practical constraints on construction methods, etc. The toroidal transformer, which has the characteristics of minimizing materials and magnetic leakage losses, is generally the most optimum core type transformer design currently available. However, toroidal transformers cannot be easily configured into 3-phase transformers where portions of the core can share and partially cancel magnetic flux vectors.

The technical challenge in designing transformers is only exacerbated with increase in power losses due to the winding current. Larger power transformers produce more heat. The relationship between dissipation and temperature rise as a function of transformer dissipating surface area is not a linear function, and below a certain critical surface area, losses and temperature rise vs. winding current increase exponentially. This critical surface area is a constraint on the size of the transformer. Furthermore, as cores get larger the ratio of surface area to volume of material decreases, thus the capacity to dissipate heat becomes more of a problem for a certain dissipation per cubic meter. In high power transformers cores can be large enough to cause very high temperature rises inside the core causing dimensional distortion and mechanical stresses that affect magnetic properties of the core. Also, for very large transformers, the core heat affects the winding adjacent to the core requiring extra spacing to cool the core and winding. This further decreases efficiency of the transformer, and increases material costs, noise and vibration of the transformer.

Accordingly, a topology for a transformer is required that can reduce material costs, improve efficiency, or provide a compact arrangement with acceptable thermal dissipation for a given power requirement.

SUMMARY OF THE INVENTION

It is therefore an object of the invention to provide an improved transformer topology for providing step-up or step-down voltage transformation for the electrical distribution and power industries.

It is a further object of the invention to provide a transformer with improved efficiency, and a more compact arrangement using less and/or lower cost materials, in comparison with standard known transformers.

In accordance with the invention there is provided, in accordance with an aspect of the invention, a transformer comprising: a two-part core composed of a magnetic material, including a toroidal piece having an inner wall, and an outer wall, and a shell piece having an inner wall and an outer wall, the toroidal piece being concentrically disposed within the shell piece; and at least two windings disposed in a space formed between the outer wall of the toroidal piece, and the inner wall of the shell piece.

The invention further provides a method for designing a transformer of a given power for a predetermined application, the method comprising: selecting dimensions of a toroidal piece and a shell piece of a two-part core to provide balanced magnetic flux paths on either radial side of a space between the toroidal piece inserted within the shell piece, which space houses at least two windings; solving equations 1 and 2 to compute a surface area of the core required to ensure thermal equilibrium of the transformer under specified operating conditions:

equation 1:

$$T = \frac{(R_{Th} \cdot A \cdot 25 \cdot 4^2 \cdot \beta + 1)\{[(20 - t_{amb})\alpha - 1] \; I_P^2 \cdot R_0 - P_{CoreLoss}\} - t_{amb} \cdot A \cdot 25 \cdot 4^2 \cdot \beta)}{(R_0 \cdot \alpha \cdot R_{Th} \cdot I_P^2 - 1)A \cdot 25 \cdot 4^2 \cdot \beta + R_0 \cdot \alpha \cdot I_P^2}$$

equation 2:

$$Pd = I^2 \cdot Ro \cdot \left| I + \alpha \cdot \left[ \frac{[Rth \cdot (A \cdot 25 \cdot 4^2 \cdot \beta) + 1] \cdot [[(20 - \text{t_amb}) \cdot \alpha - 1] \cdot I^2 \cdot Ro - \text{Core_loss}] \ldots + \text{t_amb} \cdot (A \cdot 25 \cdot 4^2 \cdot \beta)}{(Ro \cdot \alpha \cdot Rth \cdot I^2 - 1) \cdot A \cdot 25 \cdot 4^2 \cdot \beta + I^2 \cdot Ro \cdot \alpha} + \text{t_amb} - 20 \right] \right| + \text{Core_loss}$$

wherein A represents an area of vertical heat dissipative surface of the two-piece core (square inches), $\alpha$ represents the temperature coefficient of a resistance of a particular winding, $\beta$ represents a dissipation constant of the two-part core ($\mu W/mm^2/°$ C.), $I_P$ represents a total current referred to the windings, $P_{CoreLoss}$ represents total losses contributed by the core, $P_D$ represents a power dissipation of the transformer, $R_0$ represents a total resistance of the windings referred to a particular winding, $R_{Th}$ represents a thermal resistance in (° C./W) between the windings and an external cooling medium, $_t$ represents temperature, and $t_{amb}$ represents the ambient temperature of the cooling medium; and providing cooling fins in thermal contact with the two-part core for providing the required effective surface area of the transformer.

The invention likewise provides a method of manufacturing of toroidal transformer, comprising: winding a strip of magnetic material around a spindle to form a toroidal piece having an inner wall and an outer wall; heat annealing the toroidal piece and removing a sector there from; applying a layer of insulation to the outer wall of the toroidal piece; winding a primary winding over the insulation on the toroidal piece; applying a layer of insulation over the primary winding; winding a secondary winding over the insulation applied to the primary winding; applying a layer of insulation of the secondary winding; winding a strip of magnetic material over the insulation applied to the secondary winding to form a shell piece having an inner wall contacting the insulation applied to the secondary winding and an outer wall; heat annealing the shell piece, and removing a sector there from.

BRIEF DESCRIPTION OF THE DRAWINGS

Further features and advantages of the present invention will become apparent from the following detailed description, taken in combination with the appended drawings, in which:

FIGS. 2*a-f* illustrate respective steps in a method of manufacturing the two-part core of FIG. 1;

It should be noted that throughout the appended drawings, like features are identified by like reference numerals.

DETAILED DESCRIPTION OF THE PREFERRED EMBODIMENT

The present invention provides a topology for a transformer, transformers and methods of designing and constructing a transformer to produce efficient transformers with significantly lower material costs, improved efficiency and improved thermal dissipation.

Figure 1:
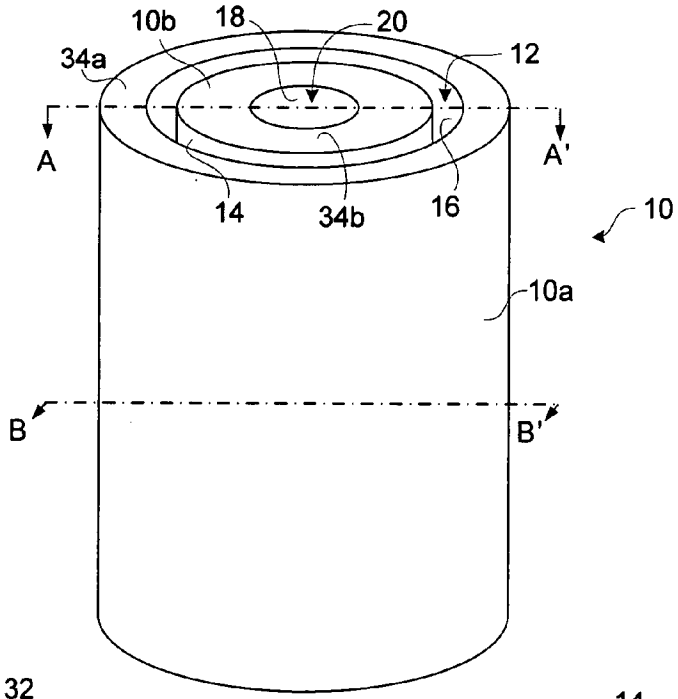
FIG. 1 is a perspective view of a two-part core for a transformer in accordance with an embodiment of the present invention.
Figure 1B:
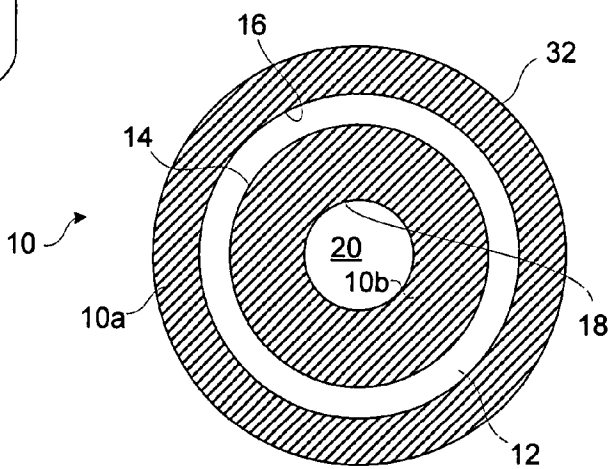
FIGS. 1*a* and 1*b* are longitudinal and lateral cross-sections respectively, of the two-part core of FIG. 1.
Figure 1A:
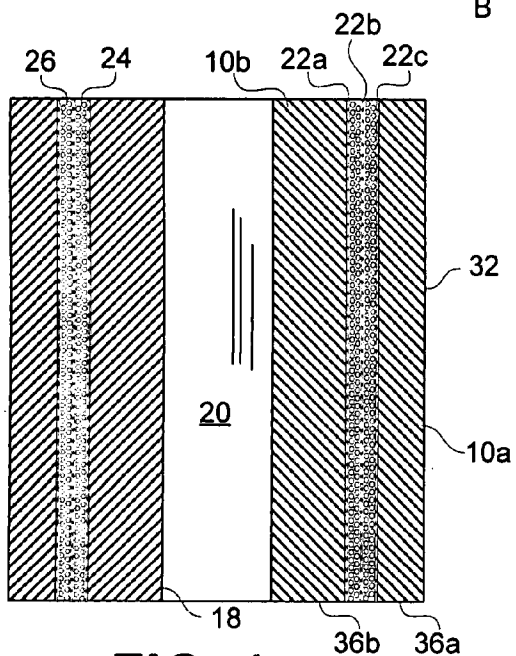

FIGS. 1, 1*a* and 1*b* schematically illustrate a transformer topology in accordance with an embodiment of the invention. The transformer topology shown includes a two-part core 10, consisting of a shell piece 10*a* and a toroidal piece 10*b* made of a magnetic material, such as magnetic steel. Both the shell piece 10*a* and the toroidal piece 10*b* are hollow cylindrical pieces, with an inner radius of the shell piece 10*a* being greater than the outer radius of the toroidal piece 10*b*, although it will be appreciated that other shapes of the shell piece 10*a* and toroidal piece 10*b* are equally possible if they permit the toroidal piece to be disposed concentrically within the shell piece 10*b* providing a space between the two. Because the toroidal piece 10*b* is concentrically disposed within the shell piece 10*a*, the space 12 is formed between an outer wall 14 of the toroidal piece 10*b*, and an inner wall 16 of the shell piece 10*a*.

The toroidal piece 10*b* has an inner wall 18 that defines an inner cooling duct 20 for the transformer. As shown, the inner cooling duct 20 may be a cylindrical opening; however it will be appreciated by those skilled in the art that other shapes for this opening are possible. The primary function of the cooling duct 20 is to permit the cooling of the toroidal piece 10*b*, by increasing a surface area of the two-part core 10.

Dimensions of the shell piece 10*a* and toroidal piece 10*b* are preferably chosen to compensate for the fact that while the flux passing through the toroidal piece 10*b* equals the flux passing through the shell piece 10*a*, the flux density of the toroidal piece 10*b* is equal to that of the shell piece 10*a* because of the cross-sectional area of the shell piece 10*a* with respect to the toroidal piece 10*b*. The compensation is effected by providing a radial thickness of the toroidal piece 10*b* that is greater than that of the shell piece 10*a*. In this manner an area of the flux path through the shell piece 10*a* is equal to that of the flux path through the toroidal piece 10*b*.

Mathematical optimization techniques can be used to derive the optimum dimensions of the two-piece core for a given power rating of the transformer, and the associated temperature limit. In this optimization an assumption is made that all heat produced by the windings is passed through the core structure to the surrounding air. Results obtained by this optimization clearly demonstrate that the quantity of material employed by this transformer topology is substantially less than a core-type or shell-type transformer for the same losses and temperature rise.

The space 12 is of a dimension to receive at least two windings. The windings are disposed between the shell piece 10*a* and the toroidal piece 10*b* separated only by any required insulation. This is shown in FIG. 1*a*. The outer wall 14 of the toroidal piece 10*b* is covered with a layer of suitable electrical insulator 22*a*, over which a primary winding 24 is wound. The primary winding 24 is insulated with a layer of the electrical insulator 22*b*, over which a secondary winding 26 is wound. A third layer of the electrical insulator 22*c* provides a dielectric barrier between the shell piece 10*a* and the secondary winding 26.

It will be evident to persons skilled in the art that at least one aperture is required either through the shell piece 10*a*, through the toroidal piece 10*b*, or elsewhere for permitting terminals of the windings to pass from the space 12 to an exterior of the transformer. This aperture may be provided in any suitable manner, and may be provided by a yoke used to cap opposite ends of the two-part core, or may be provided by both the yoke(s) and caps in the shell piece 10*a* or toroidal piece 10*b*.

As a thermal model, the total heat flow capacity from the windings 24, 26 to the outside cooling medium is far greater than if the windings are exposed to air alone.

This is for two reasons:

- the surface area of contact between the windings 24, 26 and the two-part core 10 (along the outer wall 14 and inner wall 16) is sufficiently large to permit heat conduction to be superior to the air convection processes of regular transformers; and
- the thermal flow is radial so the effective cooling surface area exposed to the ambient cooling medium is larger than if the windings were directly exposed to air.

As steel is a much better conductor of heat than air, the transfer of heat from the winding to the core is more effective, and as the radiative outer surface of the two-part core is of a much greater surface area than the windings, there is also improved heat dissipation from the core with respect to the ambient medium.

Another thermal advantage of this transformer topology is that inexpensive cooling fins can be added to an outer wall 32 of the shell piece 10*a*, and/or to the inner wall 18. Such cooling fins are in thermal equilibrium with the two-part core 10, and can dramatically increase a surface area of the core for cooling purposes, to further augment the heat dissipation capability of the transformer.

The electrical insulation layers 22 present an impediment to the radial thermal conductivity of the two-part core that induces a corresponding temperature rise within the transformer. In general, the temperature rise within the transformer follows formula 1.

Formula 1:

$$T = \frac{(R_{Th} \cdot A \cdot 25 \cdot 4^2 \cdot \beta + 1)\{[(20 - t_{amb})\alpha - 1]\ I_P^2 \cdot R_0 - P_{Coreloss}\} - t_{amb} \cdot A \cdot 25 \cdot 4^2 \cdot \beta)}{(R_0 \cdot \alpha \cdot R_{Th} \cdot I_P^2 - 1)A \cdot 25 \cdot 4^2 \cdot \beta + R_0 \cdot \alpha \cdot I_P^2}$$

where: A represents the vertical dissipating surface (square inches); $\alpha$ represents the temperature coefficient of the resistance of the windings; $\beta$ represents the dissipation constant of the core ($\mu W/mm^2/°$ C.); $I_P$ represents the total current referred to the primary winding; $P_{CoreLoss}$ represents the total power losses contributed by the core; $R_0$ represents the total resistance referred to the primary winding; $R_{Th}$ represents the thermal resistance in (° C./W) between the windings and the cooling medium; and, $t_{amb}$ represents the ambient temperature of the cooling medium.

The dissipation of the two-part core 10 follows formula 2.

Formula 2:

$$Pd = I^2 \cdot Ro \cdot \left| 1 + \alpha \cdot \left[ \frac{[Rth \cdot (A \cdot 25 \cdot 4^2 \cdot \beta) + 1] \cdot [[(20 - \text{t_amb}) \cdot \alpha - 1] \cdot I^2 \cdot Ro - \text{Core_loss}] \ldots + \text{t_amb} \cdot (A \cdot 25 \cdot 4^2 \cdot \beta)}{(Ro \cdot \alpha \cdot Rth \cdot I^2 - 1) \cdot A \cdot 25 \cdot 4^2 \cdot \beta + I^2 \cdot Ro \cdot \alpha} + \text{t_amb} - 20 \right] \right| + \text{Core_loss}$$

It will be appreciated by those skilled in the art that the dissipation and temperature rise functions demonstrate that below a certain critical dissipative surface area, losses in transformers increase exponentially. In accordance with the invention, additional winding material is not required and no changes in the configuration of the core are required, and all core material is used to create the magnetic flux path for the transformer.

If additional cooling is required, cooling fins, such as an aluminum sheet may be placed in thermal contact with the two-part core to provide cooling similar in principle to that of baseboard heaters. This minimal use of core material is a very important feature for designs that comply with recent legislation governing transformers. Canadian bill C802.2 dictates that transformer efficiency of 30 KVA sized units must be 97.5% at 0.35 p.u., whilst the U.S Department of Energy is pursuing efficiency figures at 0.5 p.u.

It is a well known rule of thumb that transformer efficiency peaks when the core losses are substantially equal to the winding losses. When designing transformers to comply with these energy efficiency standards, the development engineer is faced with the dilemma of basing his design on core loss at 0.35 p.u.-0.5 p.u. while maintaining reasonable copper losses at full load. This results in a design that is more expensive to construct due to increase in material costs. Using the transformer topology shown in FIG. 1, the enhanced conduction cooling of the windings through the reduced volume core eliminates this problem because cooling fins can be added to dissipate losses for the full power load.

An example illustrates the thermal dissipation properties of the current transformer topology. A transformer with a two-part core was loaded with 20A input current (20% above the calculated rating). At 20A input current and a surface area of 500 sq. in. (for the same insulation thermal resistance), the power dissipation was 774 W, maintaining an efficiency of almost 94% at the 20% overload. At full load, efficiency is preserved at over 95%. The transformer therefore surpasses government legislated energy efficiency requirements in North America and Europe, which is typically 95% efficiency at 0.35 p.u. for transformers of 30 KVA.

Once a transformer has been designed, the manufacture of a transformer may be effected according to the method schematically illustrated in FIGS. 2*a-f*. The method begins with the fabrication of the toroidal piece 10*b*. In the illustrated embodiment, the toroidal piece 10*b*1 is formed by rolling a strip or laminations of a steel supply 40 to a predetermined thickness. The steel 40 is preferably laminated to reduce eddy currents within the resulting toroidal piece 10*b*, when in use. FIG. 2*a* shows the initial forming of the toroidal piece 10*b*1. It will be appreciated by those skilled in the art that the application of the steel supply 40 may be performed by winding the steel strip or laminations about a spindle that defines the inner wall 18 of the toroidal piece 10*b*, while supplying sufficient tension to provide the desired density of the core.

Once the desired thickness of the toroidal piece 10*b*2 is achieved (FIG. 2*b*), the steel supply 40 is cut and the now cylindrical toroidal piece 10*b*2 is subjected to a heat annealing treatment, schematically illustrated in FIG. 2*b*, in a manner well known in the art.

In FIG. 2*c* a sector 42 has been removed from the treated piece. The sector or gap 42 is cut through the toroidal piece 10*b*3 to prevent magnetic flux (which travels in the axial direction) from inducing an electric field in the direction of the strip steel forming the core (an azimuthal direction). The induced electric field would otherwise cause a thin insulating coating of the steel to break down to connect an adjacent strip, in which case effectively each turn of steel would then act as a poorly coupled turn of a winding. It will be appreciated by those skilled in the art that if the toroidal piece 10*b*2 is created from a powdered steel with resistive properties, for example, the tendency to induce current in an azimuthal direction is significantly reduced, and accordingly a sector need not be removed from the toroidal piece 10*b*. However, the aperture(s) for the winding terminations have to be provided in the transformer and the aperture(s) may be in part or in whole supplied by a channel through the toroidal piece 10*b*.

In FIG. 2*d* the electrical insulator 22*a* is applied to the toroidal piece 10*b*, and on of a secondary or a primary winding 24 is wound about the toroidal piece 10*b*. In general, secondary windings of a transformer are wound first, however the transformers in accordance with the invention permit the primary or the secondary to be would in either order. In this example, however, the primary winding 24 is applied to the toroidal piece 10*b*. Terminations 44*a*, 44*b* of the primary winding 24 in accordance with the illustrated embodiment are drawn away from the primary windings 24 on the outer wall 14 of the toroidal piece 10*b* adjacent the sector 42 (or other passage for the terminations).

Subsequently, the exposed surface of the primary winding 24 is covered with the electrical insulator 22*b*, in preparation for applying the secondary winding 26. As is shown in FIG. 2*e*, the secondary winding 26 is applied about the toroidal piece 10*b*.

Steps shown in FIGS. 2*a*, 2*b*, and 2*c* are repeated to produce the shell piece 10*a* in a like manner. The outer surface defined by the secondary winding 26 is covered with the insulating material 22*c*, and the shell piece 10*a* is wound concentrically over the secondary winding 26, as shown in FIG. 2*f* and then annealed before the sector is removed. The terminations 44*a*, 44*b*, 46*a*, and 46*b* of the primary and secondary windings 24, 26 are insulated and passed through the sector 42 removed from the shell piece 10*a*, completing the manufacture of a transformer module 48.

Figure 3:
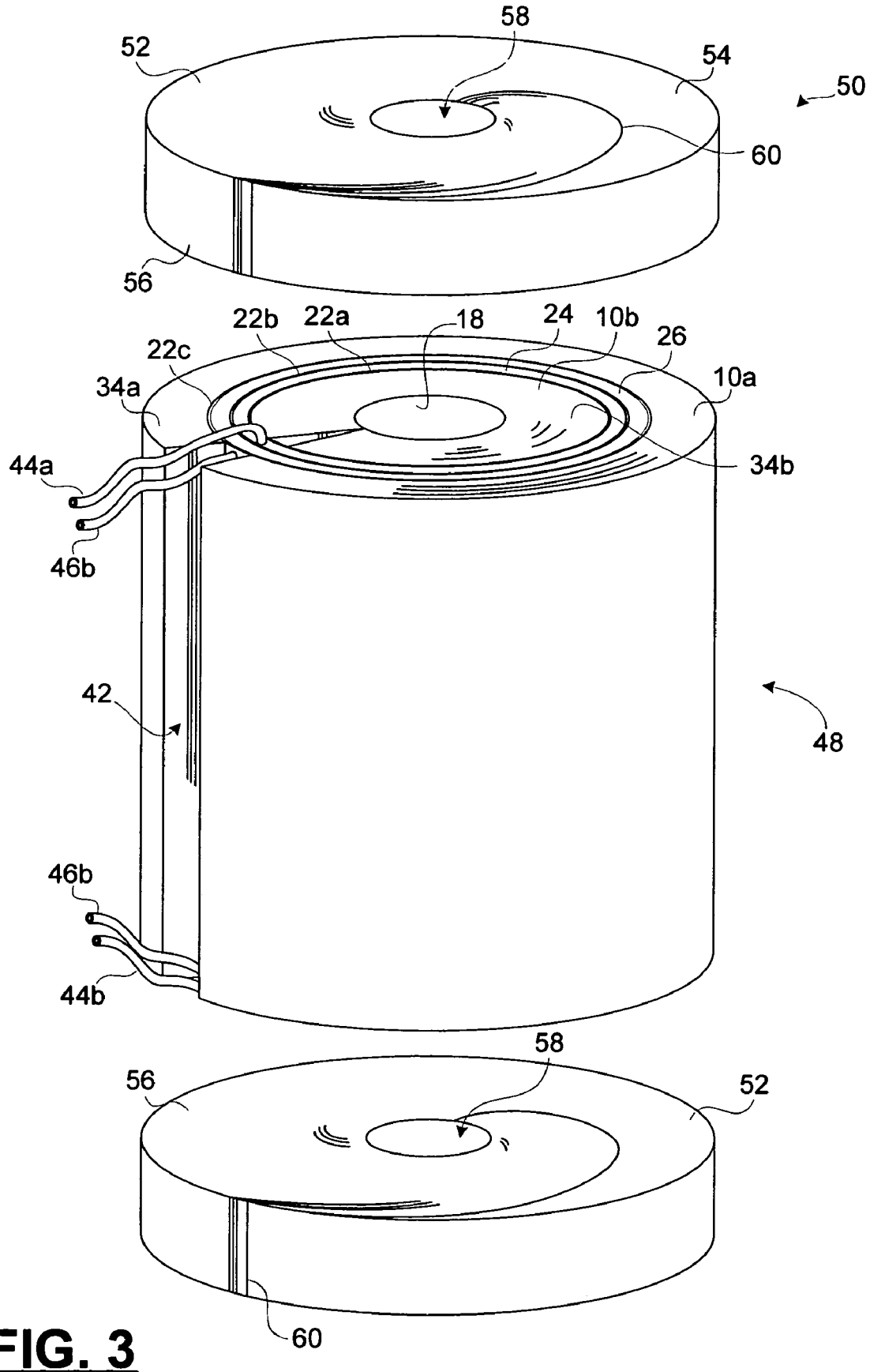
FIG. 3 is a partially exploded illustration of a transformer incorporating the two-part core of FIG. 1 in accordance with an embodiment of the present invention.

FIG. 3 is a partially exploded view of a transformer 50 manufactured using the transformer module 48 manufactured according to the method shown in FIGS. 2*a-f*. The transformer 50 consists of the module described above and top and bottom yokes 52. The yokes 52 are laminated annular pieces having an exposed surface 54, a core-contracting surface 56, and a passageway 58 between the exposed and core-contracting surfaces 54, 56 that extend the cooling duct 20 of the transformer 50.

The yoke 52 is made of magnetic material and is designed so that the yokes 52 and the two-part core 10 provide a closed magnetic flux path that is minimally separated from the windings 24, 26. Accordingly the yokes 52 are of a dimension to cover the top 34*a* of the shell piece 10*a*, and the top 34*b* of the toroidal piece 10*b*, and the core-contracting surface 54 is designed to electromagnetically couple the yoke 52 with the toroidal piece 10*b* and the shell piece 10*a*. A thickness of the yokes 52 separating the meeting and exposed surfaces 54, 56 is preferably chosen to be approximately equal to the radial thickness of the toroidal piece 10*b*.

The yokes 52 may be constructed from strip steel and are preferably configured to minimize eddy currents. As illustrated a yoke designed to minimize eddy currents may be constructed from strip steel by securing equal length pieces 60 of the strip steel in a jig having a core defining the passageway 58. With the pieces 60 secured in the jig, an azimuthal force is applied to the free ends of the strips, in order to rotate the free ends. Such rotation radially compacts and densifies the yoke 52. After the yoke 52 is compacted, it is annealed.

The yokes 52 serve to sealably enclose the transformer 50. Certified sealing materials are known in the art for sealably enclosing transformers. Accordingly the transformer 50 designed in accordance with the present invention is suitable for use in damp, wet or hazardous environments. For example, construction method can be used for transformers of 1000 VA to over 20 MVA and when sealed using proper compounds do not require enclosures, as will be described in detail below with reference to FIGS. 6*a* and 6*b*. The transformer 50 can operate in damp or wet conditions when sealed, without expensive NEMA 3 and higher-rated enclosures.

The shell piece 10*a* also serves to reduce noise and vibration. Vibration is further reduced by the fact that the windings are tightly restrained between the toroidal piece 10*b* and shell piece 10*a* without spacers etc.

Figure 4A:
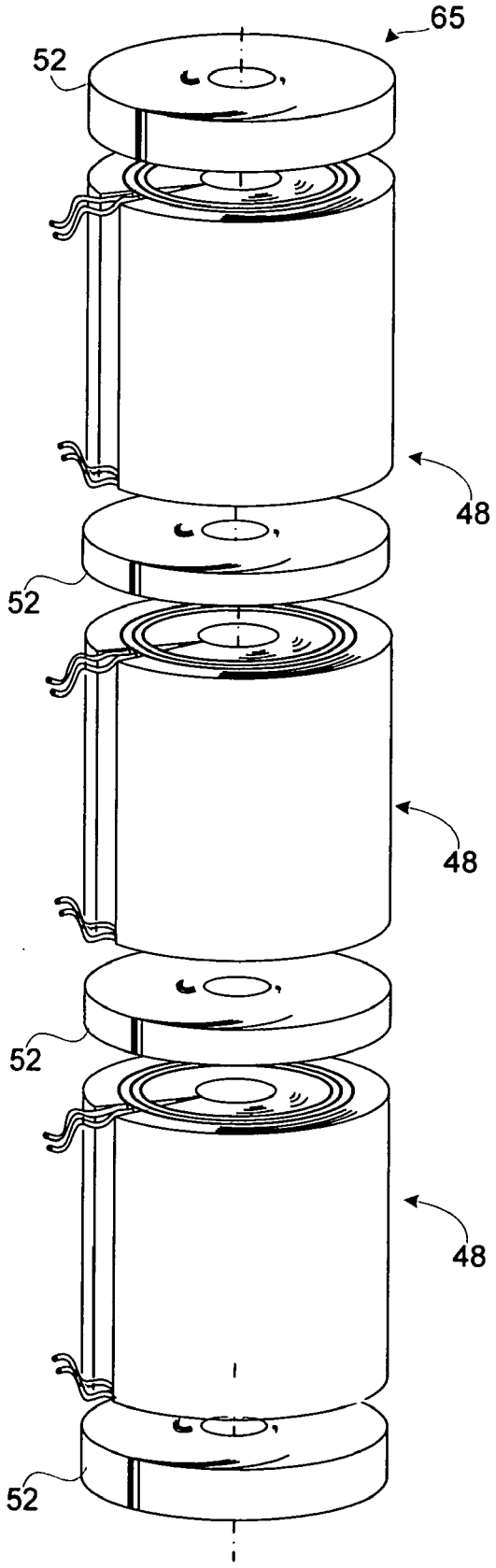
FIGS. 4*a* and 4*b* are exploded and assembled views, respectively of a multi-phase transformer consisting of three axially aligned transformers cores in accordance with FIG. 1.
Figure 4B:
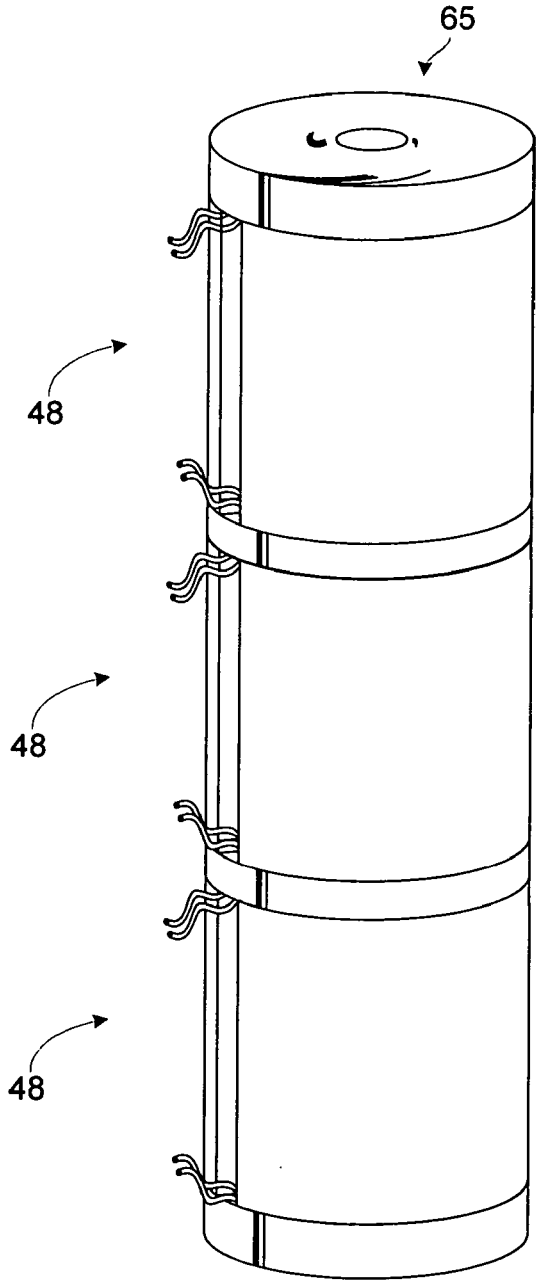

FIGS. 4*a* and 4*b* are exploded and assembled views of a multi-phase transformer 65 consisting of three axially aligned transformers modules 48 with respective top and bottom yokes 52, and yokes 52 between each transformer module 48. The transformer modules 48 may be stacked to provide a magnetic flux conserving arrangement for multi-phase applications. The yokes 52 separating transformers modules 48 may be thinner than the top and bottom yokes 52 to obtain more material savings, because the flux density in the three-phase transformer 65 is lower.

Figure 5A:
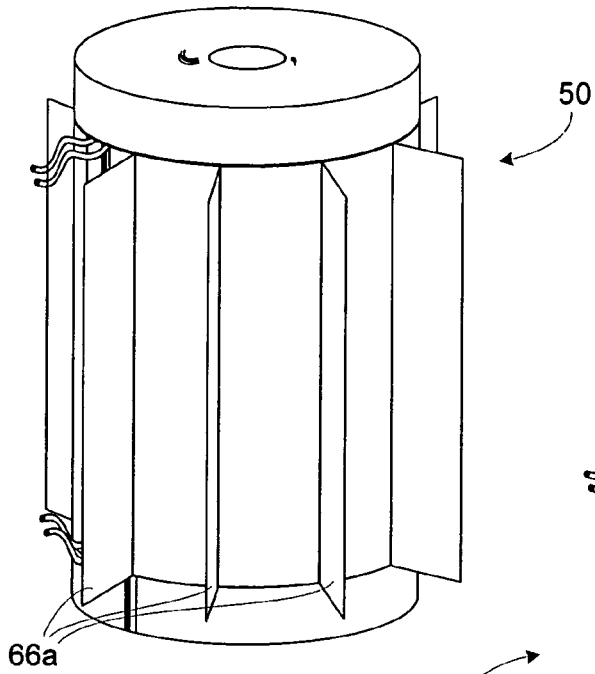
FIGS. 5*a*, 5*b* and 5*c* illustrate transformers in accordance with FIGS. 3 and 4*a-b* provided with cooling members.
Figure 5B:
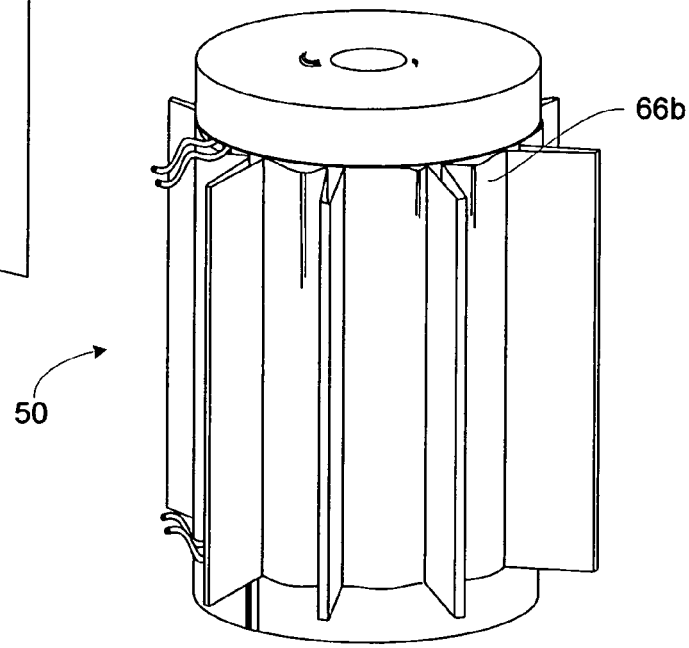
Figure 5C:
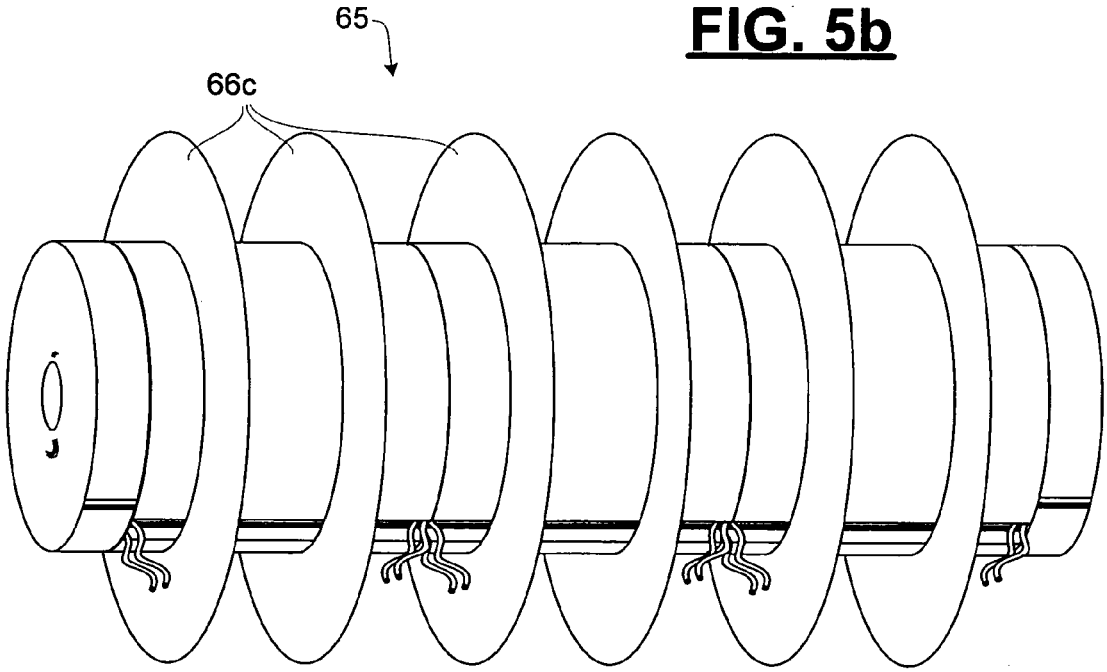

FIGS. 5*a*, 5*b* and 5*c* are three embodiments of transformers equipped with cooling fins of different types. Because of the closure of the transformers 50, 65 the core can be cooled with the addition of one or more cooling fins 66 which can be of various shapes, including longitudinal fins 66*a* affixed to an outer surface of the transformer 50; a sheet 66*b* folded to form fins 66 wrapped around an outer surface of the transformer 50; or disc-shaped fins 66*c* affixed to the outer surface of the transformer 50. Other shapes that effectively increase the surface area of the two-part core 10 to increase the efficiency of the heat dissipation may also be used. The discs 66*c* shown in FIG. 5*c* are particularly useful for horizontally oriented transformers 50, 65.

Figure 6B:
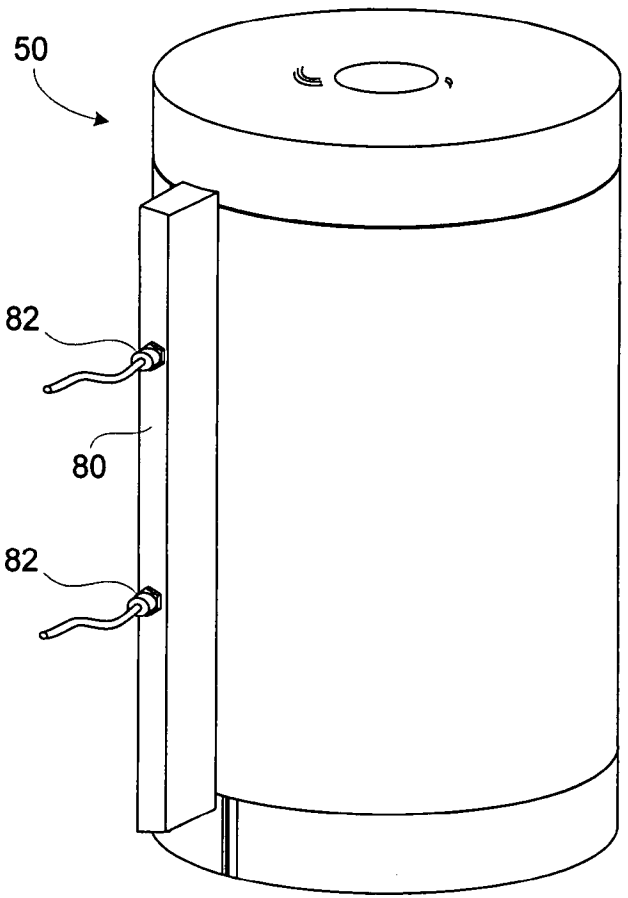
FIG. 6*b* is an assembled view of the transformer shown in FIG. 6*a*.
Figure 6A:
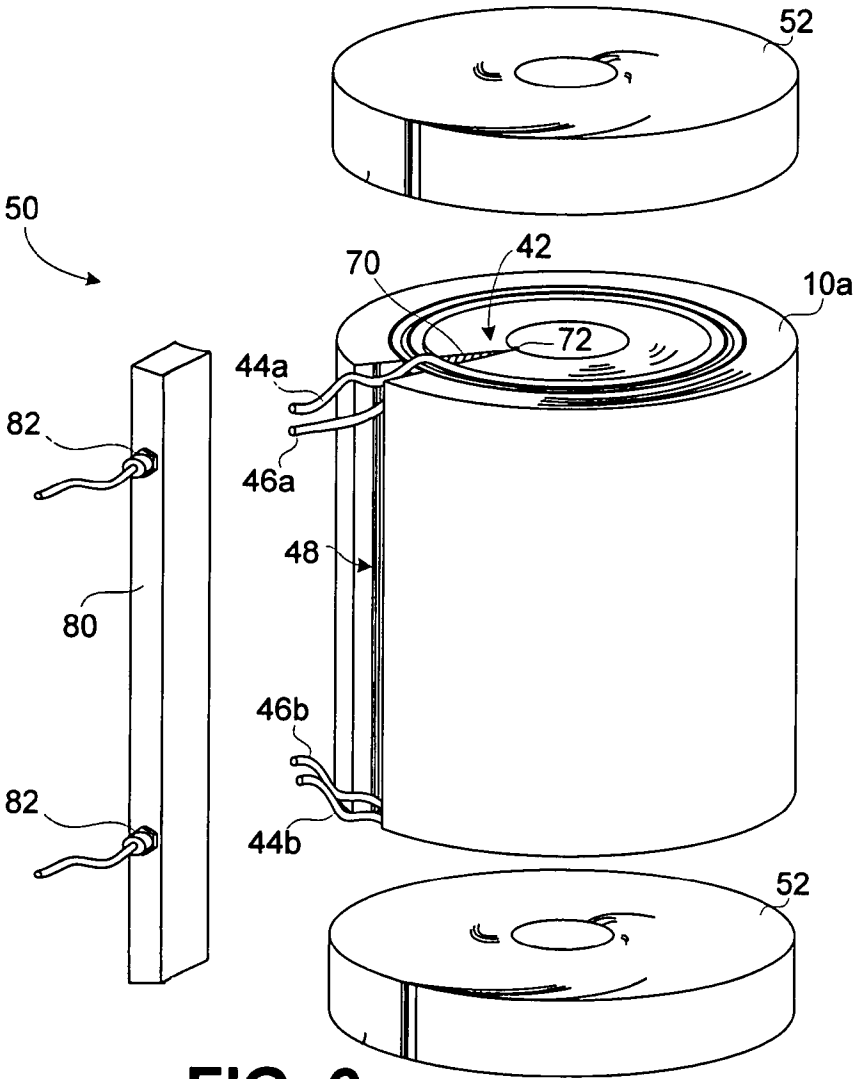
FIGS. 6*a* is a partially exploded view of a sealed transformer incorporating the two-part core of FIG. 1 in accordance with an embodiment of the present invention.

FIG. 6*a* is an exploded schematic view of a sealed transformer 50 in accordance with one embodiment of the invention. The transformer 50 is economically sealed without an expensive NEMA 3, or higher, enclosure. In this embodiment, sealing of the transformer is accomplished by sealing the sector 42 removed from the toroidal piece 10*b*, and the sector 48 removed from the shell piece 10*a*. Sealing the sector 42 may be accomplished by, for example, placing insulation 70 in the sector 42 and applying a bead of sealant 72 where the sector 42 intersects the inner wall 18 of the cooling duct through the toroidal piece 10*b*. The sealant 72 can be the same sealant used to seal the yokes 52 to the two-piece core, as described above. Sealing the sector 48 may be accomplished by sealingly securing a connector box 80 to the outer sidewall of the shell piece 10*a* so that it covers the sector 48, after the yokes 52 are sealed to the top and bottom ends of the shell piece 10*a* and the toroidal piece 10*b*, as also described above. The connector box can be of any size to permit easy bending and termination of the wires. The connector box 80 supports two or more power source feed-throughs or connectors 82, which are commercially available and well known in the art. The assembled transformer is shown in FIG. 6*b*.

As will be understood by those skilled in the art, the transformer shown in FIG. 6*b* is economically constructed and can be used in exposed weather conditions or damp environments.

It should be noted that less expensive magnetic materials can be used to create the two-part core to achieve performance comparable to prior art transformers, at a lower cost. The magnetic material grading system well known in the art (the 'M' grading system) characterizes materials according to maximum magnetic material losses per pound weight at 50 Hz or 60 Hz, usually for flux densities of 15,000 Gauss or 1.5 Tesla(T). For example, M6 grade specifies that losses shall be below 0.6 W per pound at 1.5 T (60 Hz), and M19 grade gives a maximum loss of 1.9 W per pound under the same conditions. The better grades M6, M4 and so on, are usually grain orientated, so that the losses are guaranteed only in one particular flux direction, defined with respect to the rolling direction of the steel. M19, M22 and lower grades are usually not grain orientated and give substantially equal losses in either direction of flux flow.

To account for imperfect orientation of the grain with respect to the flux, loss figures are also commonly given for 75% flux in grain and 25% cross grain conduction and typically, effective losses for M6 are approximately 1 W per pound. The cost of these materials varies with the grade. M19 grade, for example, is 15% ~25% less expensive than M6 grade, and certain grades of M4 gauges can be almost twice as expensive as M6. Manufacturing cores with grain-orientation constraints increases the complexity and cost of the designs.

The transformer topology shown also minimizes joints in the transformer core and accordingly losses associated with the core joints are reduced.

This invention is not restricted to transformers and transformer manufacture processes but can also be applied to ballasts and inductive devices which also use windings and magnetic cores. For example, chokes are commonly used for arc discharge lamp lighting or for application to motor start in large industrial machines.

The invention may advantageously be applied to air-cooled transformers but is not restricted to "dry-type" transformers, as the same principles of the topology apply to oil-cooled transformers, Sulphur Hexafluoride ($SF_6$) cooled transformers, etc. Dry-type transformers can be used for applications with extremely small power e.g. fractions of a watt or for very large power applications exceeding 20 MW.

The transformer topology can apply to the most common power frequencies (from 30 Hz to 400 Hz), however the theory and practice of the transformer 50 can be applied at any frequency deemed appropriate for the materials chosen to form the transformer in accordance with the invention.

Transformer 50 provides a transformer topology where the theoretical minimum material content can be very nearly be realized. The transformer 50, by its topology, has a high surface area to volume ratio, and in addition, the effective cooling surface area for the windings and the core is easily increased. The windings and core of the transformer 50 are concentric so that heat from the windings is conducted radially away from the windings and radiated by exposed surface of the core 10*a,b*.

The design for the transformer 50 permits the use of steel as a primary thermal transfer medium to a larger surface area. Since steel is a much better conductor of heat than air, this improves the heat dissipation of the transformer.

The transformer 50 has windings that are substantially radially outwardly enclosed by the shell piece 10*a* of a core 10, substantially enclosed on a top and bottom by respective yokes 52, and substantially enclosed radially inwardly by the toroidal piece 10*b* of the core 10. The core 10 and yokes 52 provide a shortened magnetic flux path and eliminates material waste by maximizing the utilization of materials such as winding wire and the magnetic core material. The enclosure of the windings also effectively eliminates external flux leakage.

The transformer 50 operates more quietly at elevated flux levels. Transformers in general have noise problems associated with their operation due to magnetostriction and coil vibration. Magnetostriction is the elongation and contraction of the magnetic core due to the magnetic flux flowing through it, the problem is worse in transformers having long core structures as vibration increases with length and flux density.

As the windings 24, 26 are enclosed in the shell piece 10*a*; the leakage of flux is limited to within the transformer structure. Consequently vibration by magnetic coupling to an enclosure is eliminated. The windings 24, 26 may be better constrained in accordance with the invention as they are in contact with the core via a compliant insulator and therefore vibrate less than comparable transformers when the transformer is on load.

The invention also provides heat dissipation, minimization and loss prediction algorithms for designing transformers having the two-part core.

The transformer 50 exhibits improved heat dissipation efficiency, requires substantially less core and winding material, and/or may be constructed of material of a lower cost, while enabling similar or improved performance in comparison with prior art transformers.

The embodiments of the invention described above are intended to be exemplary only. The scope of the invention is therefore intended to be limited solely by the scope of the appended claims.

I claim:

1. A transformer comprising:

a two-part core composed of a magnetic material, including a toroidal piece having an inner wall, and an outer wall, and a shell piece having an inner wall and an outer wall, the toroidal piece being concentrically disposed within the shell piece; and at least two windings disposed in a space formed between the outer wall of the toroidal piece, and the inner wall of the shell piece.

2. The transformer as claimed in claim 1 wherein the inner wall of the toroidal piece defines an inner cooling duct.

3. The transformer as claimed in claim 2 further comprising two yokes coupling the toroidal piece with the shell piece at respective axial ends of the transformer.

4. The transformer as claimed in claim 3 wherein the yokes are toroidal pieces of magnetic material having an axial passage that is aligned with the cooling duct, the yokes and the two-part core serving to provide a closed magnetic flux path for the transformer.

5. The transformer as claimed in claim 4 wherein the yokes are made of strip magnetic steel arranged to reduce eddy currents.

6. The transformer as claimed in claim 4 wherein the yokes are formed by securing the magnetic steel strips at first ends to form a ring with second ends extending radially outwards, and applying azimuthal force to the second ends of the strips to compress the strips until a solid torpid is formed.

7. The transformer as claimed in claim 4 further comprising certified sealing materials for providing a fluid seal between the yokes and the two-part cores.

8. The transformer as claimed in claim 1 wherein the two-part core has a surface area sufficient to dissipate heat in a medium of air, and the transformer is a dry-type transformer.

9. The transformer as claimed in claim 1 wherein the two-piece core is composed of powdered steel.

10. The transformer as claimed in claim 1 wherein the two-piece core is composed of laminar of strip magnetic steel.

11. The transformer as claimed in claim 10 wherein a sector of the shell piece and toroidal piece are removed to break the electrical steel winding into unconnected single turns to inhibit short circuit currents within the two-piece core.

12. The transformer as claimed in claim 11 wherein a connection for one of the at least two windings passes through one of the sector removed from the shell piece and the sector removed from the toroidal piece.

13. The transformer as claimed in claim 6 further comprising a connector box that covers a sector removed from the shell piece, the connector box being sealingly attached to the shell piece and covering the sector to seal the transformer to an external environment.

14. The transformer as claimed in claim 13 further comprising a certified sealing compound sealing a gap formed by the sector removed from the toroidal piece where the sector intersects the inner cooling duct.

15. The transformer as claimed in claim 1 further comprising a plurality of the two-part cores positioned in axial alignment to provide a multi-phase transformer.

16. The transformer as claimed in claim 15 further comprising two yokes coupling toroidal pieces with shell pieces of the two-part cores at opposite ends of the transformer, and a yoke between each of the. two-part cores.

17. The transformer as claimed in claim 1 further comprising at least one cooling fin in thermal contact with the shell core, the cooling fin effectively increasing a heat dissipating surface area of the shell core.

18. The transformer as claimed in claim 1 wherein the at least two windings comprise a primary and a secondary winding.

19. The transformer as claimed in claim 1 wherein the at least two windings comprise a first and a second winding, and the transformer operates at least one power frequency between 30 Hz and 400 Hz.

20. A two-part core for a transformer, the two part core comprising:

a toroidal piece composed of a magnetic material having an inner wall and an outer wall;

a shell piece of magnetic material having an inner wall an outer wall; and an annular space defined between the toroidal piece concentrically disposed within the shell piece for housing windings, the inner wall of the toroidal piece and the outer wall of the shell piece providing radial dissipation of heat produced in the two-part core by electrical current applied to the windings.

21. A method of manufacturing of toroidal transformer, comprising:

winding a strip of magnetic material around a spindle to form a toroidal piece having an inner wall and an outer wall;

heat annealing the toroidal piece and removing a sector therefrom;

applying a layer of insulation to the outer wall of the toroidal piece;

winding a first winding over the insulation on the toroidal piece;

applying a layer of insulation over the first winding;

winding a second winding over the insulation applied to the primary winding;

applying a layer of insulation of the second winding;

winding a strip of magnetic material over the insulation applied to the second winding to form a shell piece having an inner wall contacting the insulation applied to the secondary winding and an outer wall; and heat annealing the shell piece and removing a sector therefrom.

22. The method as claimed in claim 21 further comprising forming yokes for the transformer by:

assembling a plurality of magnetic metal strips in a jig that supports the strips in a spiral orientation around a central aperture having a diameter equal to a diameter of an aperture formed by the inner wall of the toroidal piece;

applying an azimuthal force to compress the strips into a solid toroidal piece having an outer diameter equal to a diameter of the outer wall of the shell piece; and heat annealing the yoke.

* * * * *